US006928903B1

(12) United States Patent
Liao

(10) Patent No.: US 6,928,903 B1
(45) Date of Patent: Aug. 16, 2005

(54) BIDIRECTIONAL RATCHET WRENCH WITH A RATCHET ASSEMBLY

(76) Inventor: Hui-Chen Liao, No. 14, Lane 155, Sec. 3, Hsi-Tun Rd., Taichung (TW)

( * ) Notice: Subject to any disclaimer, the term of this patent is extended or adjusted under 35 U.S.C. 154(b) by 0 days.

(21) Appl. No.: 10/842,088

(22) Filed: May 10, 2004

(51) Int. Cl.[7] ..... B25B 13/00
(52) U.S. Cl. ..... 81/58.3; 81/58.4; 81/177.8
(58) Field of Search ..... 81/58.3, 58, 58.4, 81/60, 121.1, 124.3, 176.15, 176.2, 177.85, 81/177.7, 177.8

(56) References Cited

U.S. PATENT DOCUMENTS 1,521,331 A * 12/1924 Sedgley ..... 81/58.3
4,270,417 A * 6/1981 Tesoro ..... 81/62
5,737,982 A * 4/1998 Lin ..... 81/58.3
5,875,692 A * 3/1999 Lin ..... 81/58.3
5,911,800 A * 6/1999 Roberts et al. ..... 81/177.85
6,253,645 B1 * 7/2001 Lin ..... 81/58.3

* cited by examiner

*Primary Examiner*—Joseph J. Hail, III
*Assistant Examiner*—Alvin J Grant
(74) *Attorney, Agent, or Firm*—William E. Pelton, Esq.

(57) ABSTRACT

The bi-directional wrench with a ratchet assembly can be used in small space. It includes a handle, a base attached pivotally to the handle, a rotating device mounted on the base and a bi-directional device engaged with the rotating device. The bi-directional wrench with a ratchet assembly can change the effective rotating direction conveniently.

5 Claims, 6 Drawing Sheets

BIDIRECTIONAL RATCHET WRENCH WITH A RATCHET ASSEMBLY

BACKGROUND OF THE INVENTION

1. Field of the Invention

The present invention relates to a ratchet wrench, and more particularly to a bidirectional ratchet wrench with a ratchet assembly that has a bidirectional device to conveniently change the operational direction of the wrench.

2. Description of the Prior Arts

With reference to FIGS. 5 and 6, a conventional bidirectional ratchet wrench comprises a handle (80), a base (90), a spring (91), a ratchet-socket (95), an inner split ring (93), an outer split ring (94) and a elongated pawl ring (92). The handle (80) has a proximal end (not numbered). The base (90) is attached pivotally to the proximal end of the handle (80). The spring (91) is mounted around the base (90). The ratchet-socket (95) is tubular and has a distal end (not numbered), a proximal end (not numbered) and a longitudinal passage (not numbered). The longitudinal passage at the distal end is shaped to hold a tool head (96) and the proximal end attaches to the base (90). The elongated pawl ring (92) is mounted around the base (90), presses against the spring (91) and has two ends (not numbered) and multiple teeth (not numbered). Multiple teeth are formed on each end of the elongated pawl ring (92) and have an inclined edge (not numbered) and a longitudinal edge (not numbered). The inner split ring (93) is a resilient ring and is mounted around the base (90) to hold the elongated pawl ring (92) on the base (90). The outer split ring (94) is a resilient ring, is mounted around the base (90) and engages the ratchet-socket (95).

The major problem with the conventional bidirectional ratchet wrench is the inconvenience associated with reversing the direction of operation of the wrench. To reverse the direction of operation of the wrench, the ratchet-socket (95) and the elongated pawl ring (92) must be removed first. The elongated pawl ring (92) is reversed and reinstalled on the base (90) against the spring (91). Then the ratchet-socket (95) is re-installed on the base (90) and the wrench freewheels in the opposite direction.

The conventional bidirectional ratchet wrench has a small volume and a simple mechanism. Consequently, the conventional bidirectional ratchet wrench can reach into small spaces and has a long lifetime. However, the convenience associated with changing the ratchet-socket (95) limits the tool heads (96) that can be used. The split rings (93, 94) that attach the ratchet-socket (95) and the elongated pawl ring (92) to the base (90) make removing and re-installing the ratchet-socket (95) and the elongated pawl ring (92) particularly difficult.

To overcome the shortcomings, the present invention provides a bidirectional ratchet wrench with a ratchet assembly to mitigate or obviate the aforementioned problems.

SUMMARY OF THE INVENTION

The bidirectional ratchet wrench with a ratchet assembly comprises a handle, a base, a rotating device and a bidirectional device. The base is attached pivotally to the handle and has a disk, a sleeve and an eye. A rotating device is mounted on the base. The rotating device has a pawl ring, a spring, a plug and a C-clip. The bidirectional device is engaged with the pawl ring of the rotating device.

The main objective of the invention is to provide a bidirectional ratchet wrench with a ratchet assembly that has a small volume, a simple mechanism, a prolonged useful life and is easy to operate in either direction. The direction of operation is changed by inverting a simple bidirectional device.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
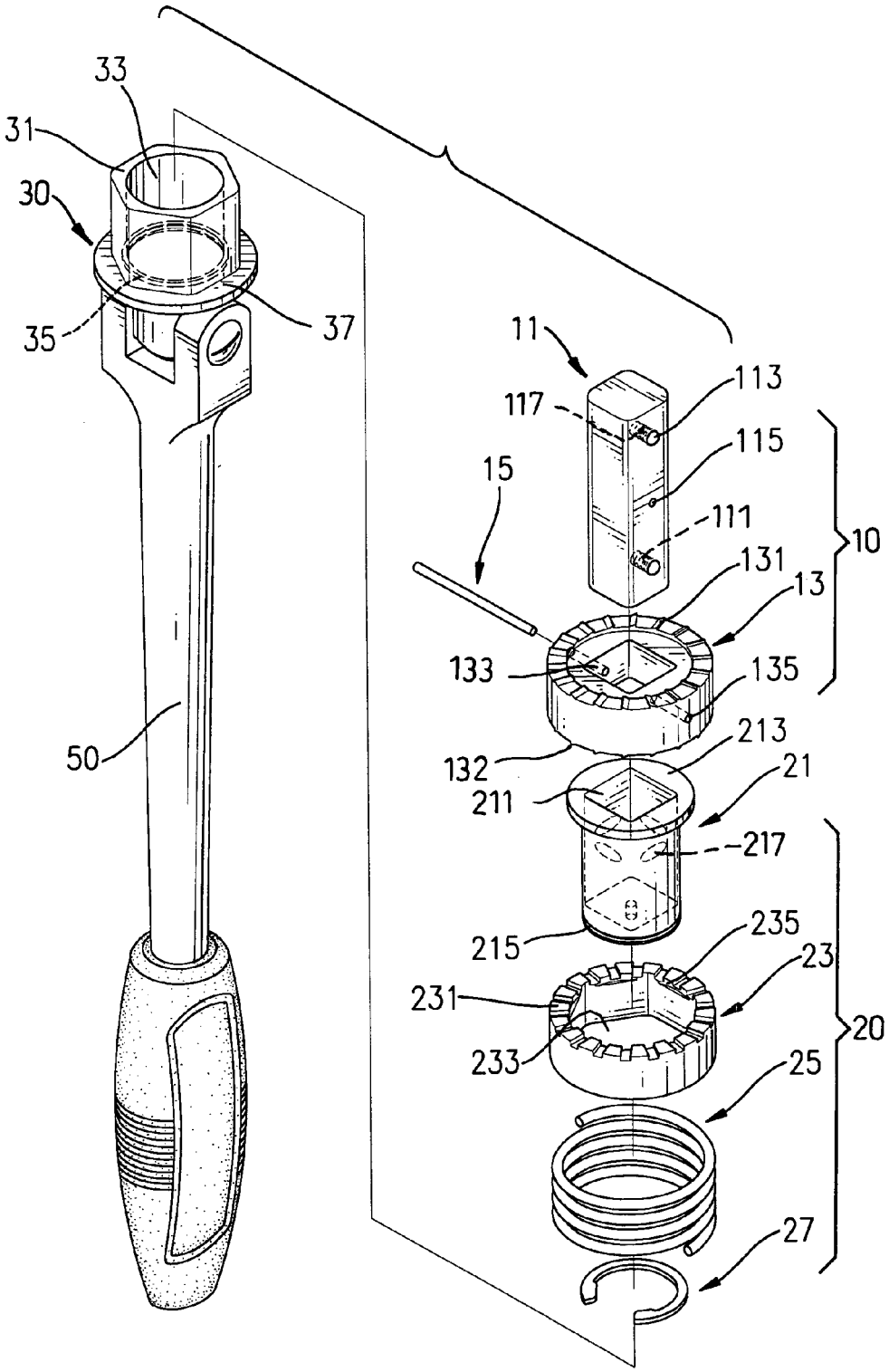
FIG. 1 is an exploded perspective view of a bidirectional ratchet wrench with a ratchet assembly in accordance with the present invention.
Figure 2:
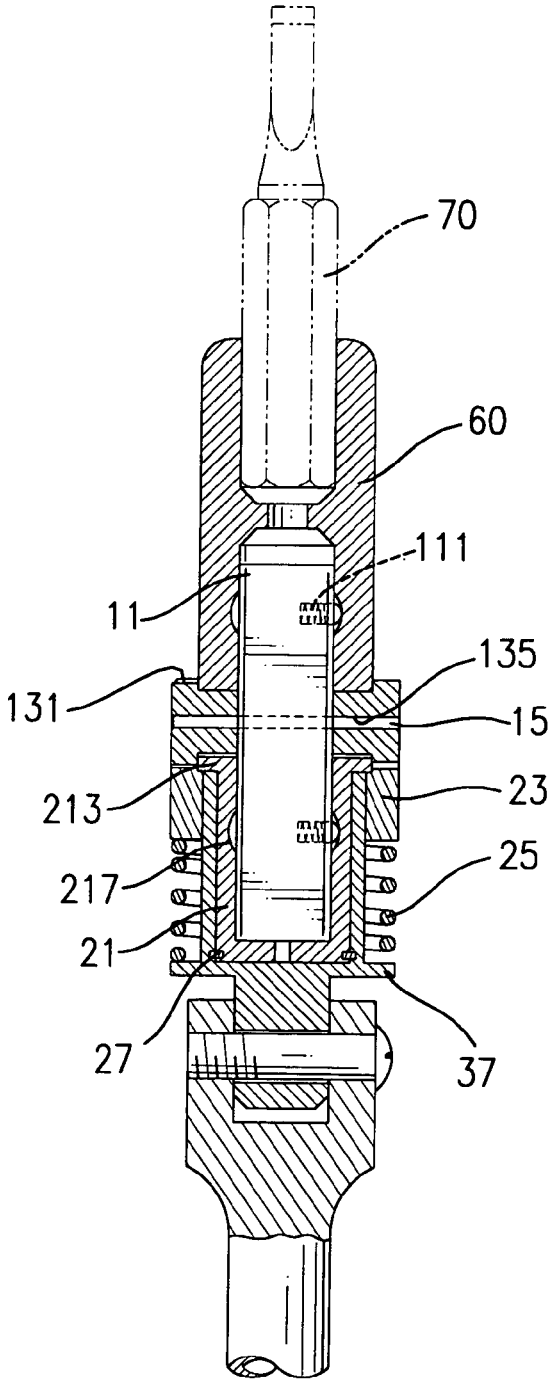
FIG. 2 is a side view in partial section of the bidirectional ratchet wrench in FIG. 1.

With the reference to FIGS. 1 and 2, the present invention comprises a handle (50), a base (30), a rotating device (20) and a bidirectional device (10). The base (30) is connected pivotally to the handle (50). The rotating device (20) is mounted on the base (30).

The base (30) has a bottom (not numbered), a disk (37), a sleeve (31) and an eye (not numbered). The disk (37) is generally circular and has a top (not numbered) and a bottom (not numbered). The sleeve (31) is formed concentrically on and protrudes from the top of the disk (37), is hollow and has a distal end (not numbered), a proximal end (not numbered), an inside surface (not numbered), an outside surface (not numbered), a longitudinal hole (33) and an inner annular groove (35). The outside surface is non-circular and may be hexagonal, elliptical, star shaped or the like. The inner annular groove (35) is formed in the inside surface of the longitudinal hole (33) near the proximal end. The eye is connected to the bottom of the disk (37) and is connected pivotally to the handle (50).

The rotating device (20) includes a pawl ring (23), a spring (25), a plug (21) and a C-clip (27).

The pawl ring (23) is mounted around the sleeve (31) of the base (30) and has a distal edge (not numbered), a proximal edge (not numbered), an inside surface (not numbered), a hole (233), multiple teeth (231) and an optional shoulder (235). The hole (233) is formed axially through the pawl ring (23), is non-circular and corresponds to the outside surface of the sleeve (31) on the base (30) so the pawl ring (23) will rotate with the sleeve (31) of the base (30). The teeth (231) are formed on and extend longitudinally from the distal edge of the pawl ring (23). The shoulder (235) is formed on the inside surface near the distal edge of the pawl ring (23).

The spring (25) is mounted around the sleeve (31) of the base (30) between the pawl ring (23) and the disk (37) of the base (30).

The plug (21) is mounted rotatably in the longitudinal hole (33) in the sleeve (31) of the base (30) and has a proximal end (not numbered), a distal end (not numbered), a non-circular hole (211), an outer annular groove (215), at least one detent (217) and an optional circular flange (213). The non-circular hole (211) is formed longitudinally in the plug (21) from the distal end. The outer annular groove (215) is formed around the plug (21) near the proximal end of the plug (21) and aligns with the inner annular groove (35) in the sleeve (31) of the base (30) when the plug (21) is seated in the longitudinal hole (33) in the sleeve (31). The circular flange (213) is formed on and extends radially out from the distal end of the plug (21). When the outer annular groove (215) is aligned with the inner annular groove (35), the circular flange (213) is seated on the shoulder (235) in the pawl ring (23) to hold the pawl ring (23) in place. At least one detent (217) is formed in the non-circular hole (211).

The C-clip (27) is mounted simultaneously in the inner annular groove (35) in the sleeve (31) of the base (30) and the outer annular groove (215) in the plug (21) of the rotating device (20) to connect the plug (21) to the sleeve (31).

The bidirectional device (10) includes a ratchet ring (13), a non-circular shaft (11) and an optional pin (15). The ratchet ring (13) engages the teeth (231) on the pawl ring (23). The non-circular shaft (11) is mounted in the ratchet ring (13) and extends into the plug (21) of the rotating device (20).

The ratchet ring (13) has a counterclockwise end (not numbered), a clockwise end (not numbered), multiple counterclockwise ratchets (131), multiple clockwise ratchets (132), a locking through hole (133) and two optional aligned pin holes (135). The ratchets (131, 132) are formed respectively on and extend from the ends of the ratchet ring (13). Each ratchet (131, 132) has a perpendicular face and an inclined face. The inclined faces of the ratchets (131,132) extend in the same direction. The locking through hole (133) is formed axially through the ratchet ring (13) and corresponds to the non-circular hole (211) in the plug (21).

The non-circular shaft (11) has two ends (not numbered), at least one longitudinal surface (not numbered), an optional set hole (115) and two positioning devices (not numbered). The set hole (115) is formed transversely through the shaft (11) and corresponds to the pin holes (135) in the ratchet ring (13). The positioning devices are installed respectively on opposite ends, protrude radially out from the shaft (11), are aligned longitudinally on the longitudinal surface and connect the plug (21) to a tool socket (60). The non-circular shaft (11) corresponds to the non-circular hole (211) in the plug (21).

The positioning devices may be implemented with conventional spring-ball combinations (not numbered) where each is comprised of a spring (111), a ball bearing (113) and a blind hole (117). Since spring-ball combinations as positioning devices are well known in the art, further description is omitted.

The optional pin (15) is pressed sequentially into one of the pin holes (135) in the ratchet ring (13), the set hole (115) in the non-circular shaft (11) and into the other pin hole (135) in the ratchet ring (13) to attach the non-circular shaft (11) securely in the ratchet ring (13). In an alternative embodiment, the non-circular shaft (11) can be welded to the ratchet ring (13).

The direction of rotation of the bidirectional device (10) is selected by changing the end of the non-circular shaft (11) installed in the non-circular hole (211) in the plug (21). The end of the non-circular shaft (11) installed in the non-circular hole (211) is changed by pulling the tool socket (60) off the outer end of the non-circular shaft (11). Then, the non-circular shaft (11) with the ratchet ring (13) is pulled out of the non-circular hole (211) in the plug (21) and inverted. The original outer end of the non-circular shaft (11) is inserted into the non-circular hole (211), and the other end is exposed. The ratchets (131, 132) that originally faced outward are now engaged by the pawl ring (23), and the bidirectional device (10) rotates in the opposite direction. Finally, the tool socket (60) is attached to the exposed end of the non-circular shaft (11).

Figure 3:
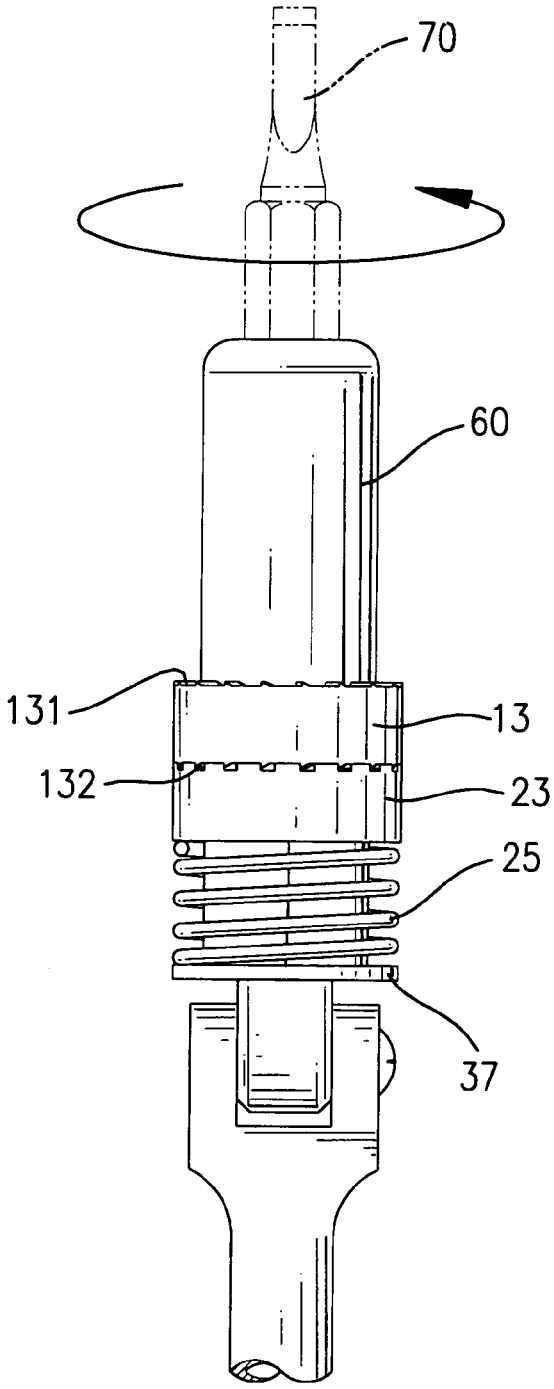
FIG. 3 is an operational side view of the bidirectional ratchet wrench in FIG. 1 rotating a tool head clockwise.
Figure 4:
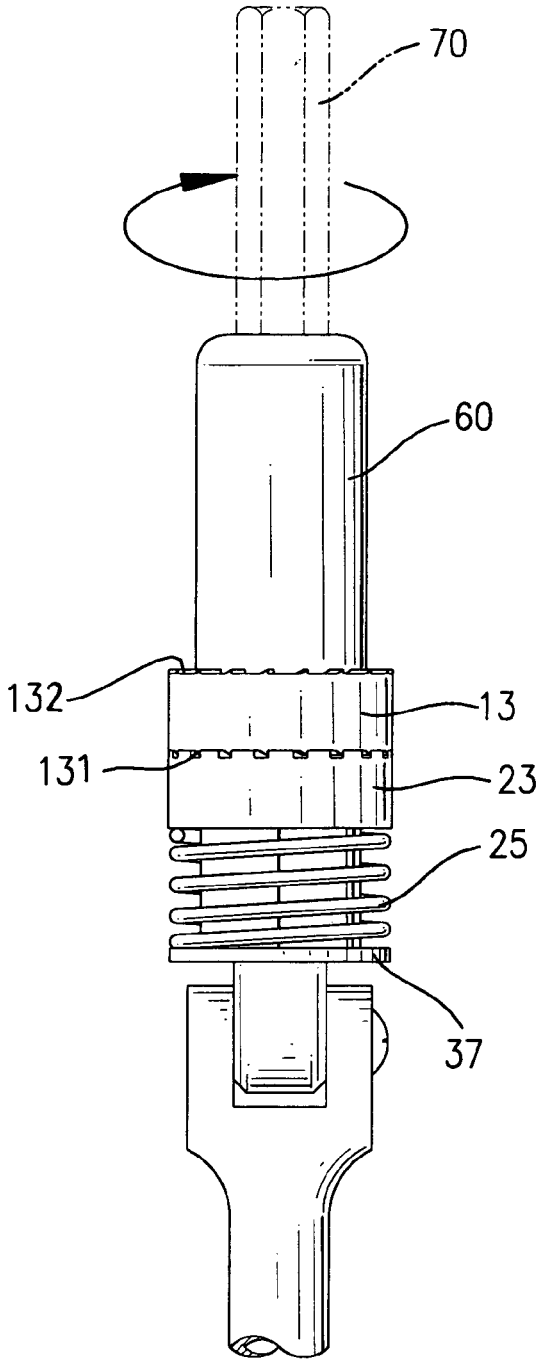
FIG. 4 is an operational side view of the bidirectional ratchet wrench in FIG. 1 rotating a tool head counterclockwise.
Figure 5:
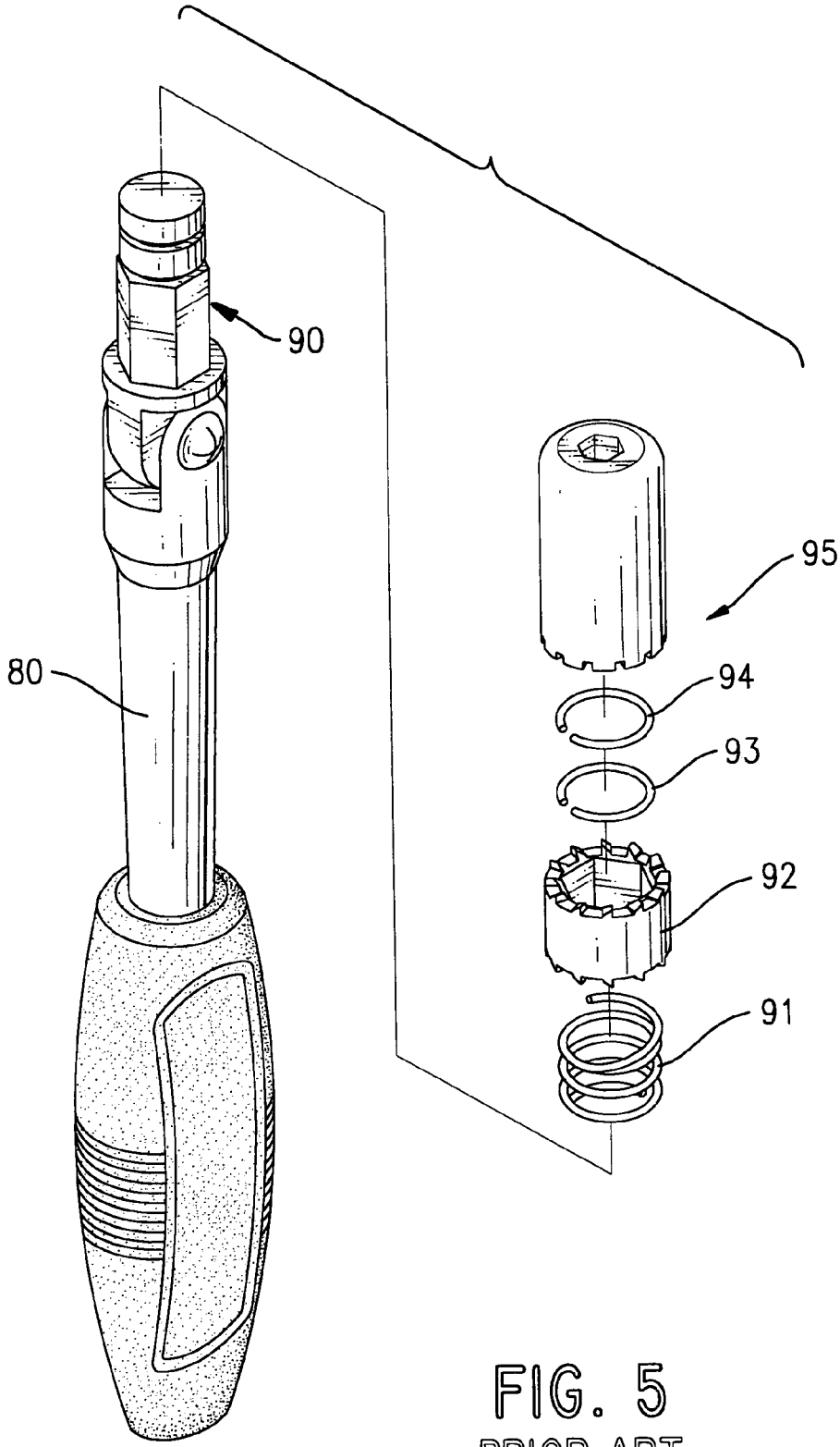
FIG. 5 PRIOR ART
FIG. 5 is an exploded perspective view of a conventional bidirectional ratchet wrench in accordance with the prior art.
Figure 6:
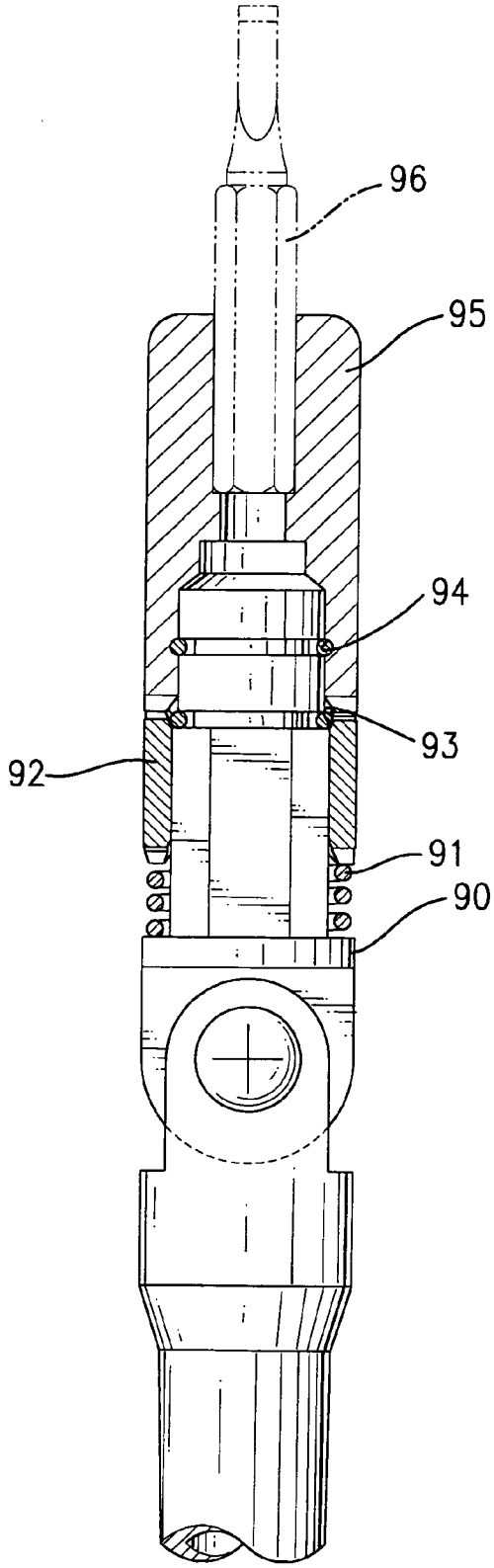
FIG. 6 PRIOR ART
FIG. 6 is a side view in partial section of the bidirectional ratchet wrench in FIG. 5.

With further reference to FIGS. 3 and 4, the teeth (231) on the pawl ring (23) engage respectively the perpendicular faces on the ratchets (131, 132) and drive the ratchet ring (13). The spring (25) pushes the pawl ring (23) against the ratchet ring (13) so the teeth (231) either engage the perpendicular face or slide along the inclined faces depending on the direction the pawl ring (23) is rotated. The wrench with a ratchet assembly as described can rotate a fixed element in either direction.

The wrench with a ratchet assembly as described has a number of distinct advantages over a conventional ratchet wrench. Specifically, the wrench as described can be used in a small space because of the simple structure and the small volume of the bidirectional device (10). The positioning devices in the noncircular shaft (11) and the detents in the non-circular hole (211) in the plug (21) make changing the direction of rotation of the bidirectional device (10) easy. The bidirectional wrench with a ratchet assembly is not easily worn. Therefore, the wrench as described has a longer useful life.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A wrench comprising a handle;

a base connected pivotally to the handle and having a bottom;

a disk having a top and a bottom;

a hollow sleeve formed on and protruding from the top of the disk and having a distal end;

a proximal end;

an inside surface;

an outside surface being non-circular;

a longitudinal hole;

an inner annular groove formed in the inside surface of the longitudinal hole near the proximal end; and an eye connected to the bottom of the disk and connected pivotally to the handle;

a rotating device having a pawl ring mounted around the sleeve of the base and having;

a distal edge;

a proximal edge;

an inside surface;

a hole formed axially through the pawl ring, being non-circular, corresponding to the outside surface of and mounted around the sleeve on the base;

multiple teeth formed on and extending longitudinally from the distal edge of the pawl ring; and a spring mounted around the sleeve of the base and between the pawl ring and the disk of the base;

a plug mounted rotatably in the longitudinal hole in the sleeve of the base and having a proximal end;

a distal end;

a non-circular hole formed longitudinally in the plug from the distal end;

an outer annular groove formed around the plug near the proximal end of the plug and aligns with the inner annular groove in the sleeve of the base; and at least one detent formed in the non-circular hole; and a C-clip mounted simultaneously in the inner annular groove in the sleeve of the base and the outer annular groove in the plug of the rotating device; and a bidirectional device having a ratchet ring engaging with the teeth on the pawl ring of the rotating device and having:

a counterclockwise end;

a clockwise end;

multiple counterclockwise ratchets formed respectively on and extend from the counterclockwise end of the ratchet ring, wherein each counterclockwise ratchet has a perpendicular face and an inclined face, and the inclined faces of the counterclockwise ratchets extend in a same direction;

multiple clockwise ratchets formed respectively on and extend from the clockwise end of the ratchet ring, wherein each clockwise ratchet has a perpendicular face and an inclined face, and the inclined faces of the clockwise ratchets extend in a direction same as the direction of the inclined faces of the counterclockwise ratchets; and a locking through hole formed axially through the ratchet ring and corresponding to the non-circular hole in the plug; and a non-circular shaft mounted through the ratchet ring corresponding to the locking through hole in the ratchet ring, extending into the plug of the rotating device and having two opposite ends;

at least one longitudinal surface; and two positioning devices installed respectively on opposite ends, protruding radially out from the shaft, aligned longitudinally on the longitudinal surface and connect the plug to a tool socket.

2. The wrench as claimed in claim 1, wherein the pawl ring further has a shoulder formed on the inside surface near the distal edge of the pawl ring;

the plug further has a circular flange formed on and extends radially out from the distal end of the plug; and the circular flange is seated on the shoulder in the pawl ring.

3. The wrench as claimed in claim 2, wherein the ratchet wheel further comprises two aligned pin holes;

the shaft further has a set hole formed transversely through and corresponds to the pin holes in the ratchet ring; and the wrench further comprises a pin pressed sequentially into one of the pin holes in the ratchet ring, the set hole in the non-circular shaft and into the other pin hole in the ratchet ring.

4. The wrench as claimed in claim 3, wherein the positioning devices is spring-ball combinations where each is comprised of a spring, a ball bearing and a blind hole.

5. The wrench as claimed in claim 4, wherein the outside surface of the sleeve is hexagonal.

* * * * *